US008747002B2

(12) United States Patent
Izkovitz

(10) Patent No.: US 8,747,002 B2
(45) Date of Patent: Jun. 10, 2014

(54) FRESHENING RING

(76) Inventor: Gdalyahu Izkovitz, Brooklyn, NY (US)

( * ) Notice: Subject to any disclaimer, the term of this patent is extended or adjusted under 35 U.S.C. 154(b) by 427 days.

(21) Appl. No.: 13/180,888

(22) Filed: Jul. 12, 2011

(65) Prior Publication Data

US 2013/0015224 A1 Jan. 17, 2013

(51) Int. Cl.
*A46B 5/02* (2006.01)

(52) U.S. Cl.
USPC ..... 401/8; 63/1.14

(58) Field of Classification Search
USPC ..... 401/6, 7, 8; 206/581; 63/1.11, 1.14, 15, 63/15.1, 1.1, 15.11
See application file for complete search history.

(56) References Cited

U.S. PATENT DOCUMENTS

| | | | | |
|---|---|---|---|---|
| 247,033 | A * | 9/1881 | Fisher | 118/201 |
| 2,954,573 | A * | 10/1960 | Campbell, Jr. | 401/8 |
| 6,397,633 | B1 * | 6/2002 | Wu | 63/1.11 |
| 6,474,345 | B2 * | 11/2002 | Rodriquez et al. | 132/286 |

* cited by examiner

*Primary Examiner* — David Walczak
(74) *Attorney, Agent, or Firm* — Evelyn M. Sommer

(57) ABSTRACT

The subject wearable ring assembly comprises a ring shank portion, integrally or mechanically connected to a personal care product receptacle, which is mechanically or frictionally connected to a protective cap element configured to contain and protect personal care products stored in the receptacle. The ring shank portion is sized to fit a wearer's finger or is adjustable to fit a wearer's finger. The ring is made from jewelry grade materials selected from precious metals such as gold and silver or costume jewelry grade materials selected from non-precious metals, thermo-formable plastic resins, ceramics, leather, fabrics or woven materials.

14 Claims, 8 Drawing Sheets

FRESHENING RING

FIELD OF THE INVENTION

The present invention relates to a ring construction adapted to facilitate use of personal care products by a wearer of the ring.

BACKGROUND OF THE INVENTION

Consumers use a variety of personal care products which include, without limitation, lip and skin balms, lotions, ointments, sunscreens and treatments, as well as a variety of cosmetic products such as lipstick and glosses.

Often it is necessary to apply or reapply such products at frequent intervals and this sometimes necessitates application at inconvenient times.

Further, depending upon environmental circumstances, it is sometimes a nuisance to carry the required products at all times.

It will be recognized that there is a need for a convenient receptacle for such personal care products which not only contains the required components, but facilitates the ready availability of such products whenever necessary. To have such convenient availability as well as a variety of attractive applicators will be seen as an advantage over prior methods. The present invention relates to a ring construction adapted to facilitate use of personal care products by a wearer of the ring.

All of the foregoing advantages can be accomplished with the ring construction described herein.

SUMMARY OF THE INVENTION

The present invention relates to a ring construction adapted to facilitate use of personal care products by a wearer of the ring. For instance, a chap stick or lipstick applicator may be combined with a ring assembly as described in detail below. It will be seen that the subject device can be useful for lip gloss, balms, lotions and ointments, ski products, sun screen products and the like. Furthermore, the ring assembly is equally useful indoors as well as outdoors.

The ring is worn by the user for convenient application of the contents. A cover is removed from the ring applicator to expose the contents where it may then be used directly as an applicator avoiding contact with the user's fingers.

A variety of materials may be used in the subject design including jewelry grade precious metals such as gold and silver other less expensive metals (copper, etc.), leather, woven and molded thermoplastics for less expensive applications.

A freshening ring with a decorative setting may be used. The decoration may be or be combined with, a cover for the contents. It is contemplated that the convenience of the subject device can be fashionable as well as useful.

The ring is also intended for use by children as a toy, and namely as a dispenser for applying lip gloss, balm, lotions, ointments and makeup suitable for children. Thus, in addition to being attractive to children, the ring provides for the renewable storage and transport of the contents thereof, which cannot be readily lost and which is simple to use. The contents, i.e., lip gloss, balm, makeup, chap stick and the like can be readily accessed by removing or releasing the cover to expose the contents after which it may be used directly as an applicator, avoiding contact with the wearer's fingers and without removal from the wearer's hand.

Other objects, features and advantages of the present invention will be apparent when the detailed descriptions of the preferred embodiments of the invention are considered and are to be construed in an illustrative and not limiting sense as follows:

DETAILED DESCRIPTION OF THE PREFERRED EMBODIMENTS

The subject wearable ring assembly comprises a ring shank portion, integrally or mechanically connected to a personal care product receptacle, which is mechanically or frictionally connected to a protective cap element configured to contain and protect personal care products stored in the receptacle. The ring shank portion is sized to fit a wearer's finger or is adjustable to fit a wearer's finger. The ring may be made from a variety of materials as may be desired for expense, attractiveness or convenience, such as jewelry grade materials selected from precious metals such as gold and silver or costume jewelry grade materials selected from non-precious metals, thermo-formable plastic resins, ceramics, leather, fabrics or woven materials.

The personal care product receptacle may be smooth or may further have at least one friction inducing protrusion for facilitating storage of a personal care product in the receptacle. The personal care product receptacle may have a means for connecting and holding secure the protective cap, such as a friction fitting, a screw-cap fitting, or a snap-cap fitting. Furthermore, the cap may be a decorative cap, or a decoration may be attached to a regular cap. The subject wearable ring assembly may further comprise a personal care product in the receptacle. The personal care product may be a skin care product, a lip care product, or any personal or therapeutic lotion, ointment, balm, gloss or cosmetic product.

Figure 1:
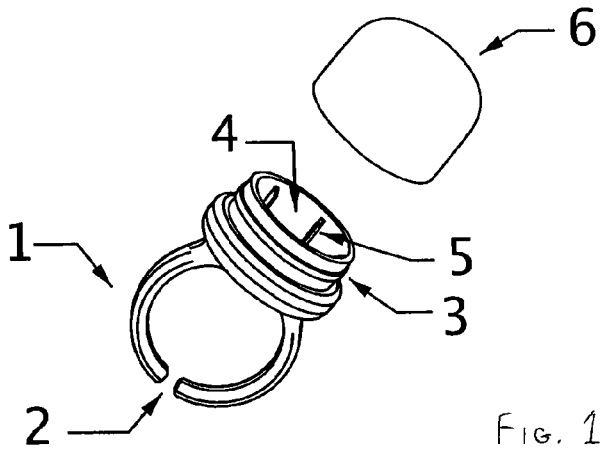
FIG. 1 is a perspective depiction of a ring and cap assembly in accordance with one embodiment of the subject invention.
Figure 2:
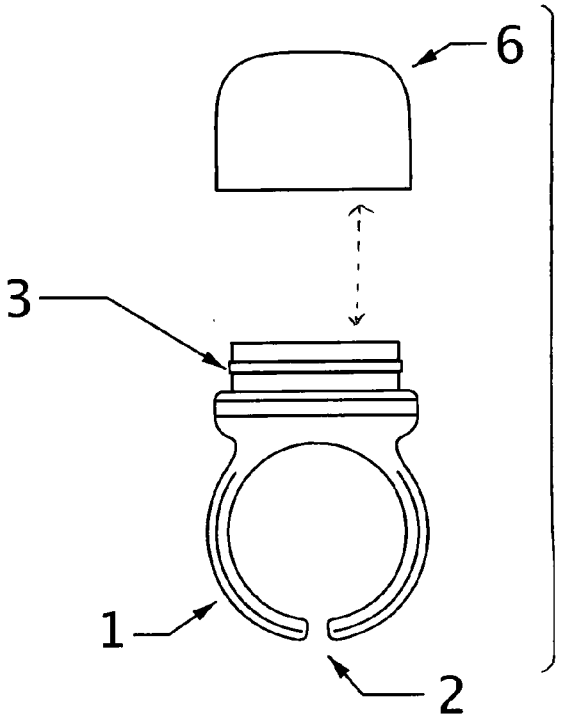
FIGS. 2-3 are elevational views of the front and side of the assembly seen in FIG. 1.
Figure 3:
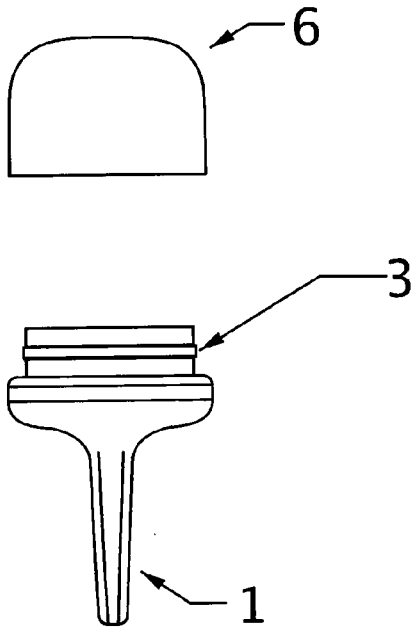

FIG. 1 is a perspective depiction of ring 1 having adjustable spacing 2, screw threads 3, personal product receptacle 4, optional friction protrusion 5 and protective cap 6. FIGS. 2-3 are elevational views of the front and side of the assembly seen in FIG. 1.

Figure 4:
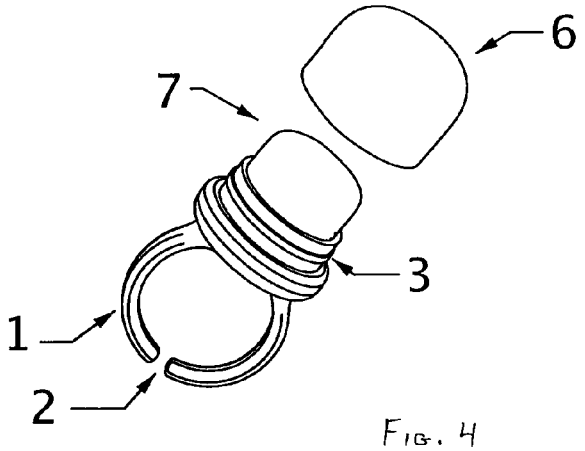
FIG. 4 is a perspective depiction of the ring and cap assembly seen in FIG. 1.
Figure 5:
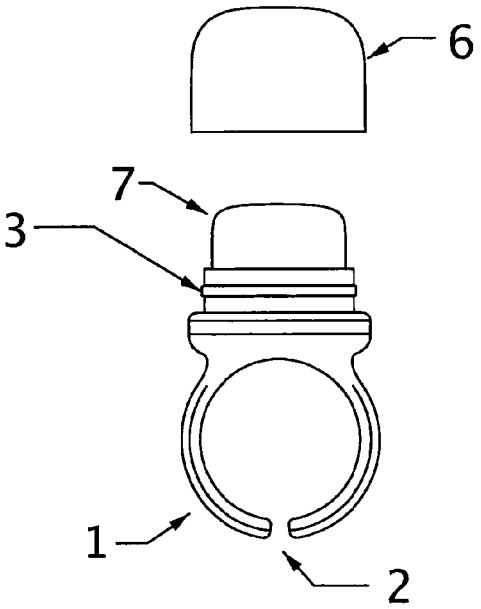
FIGS. 5-6 are elevational views of the front and side of the assembly seen in FIG. 4.
Figure 6:
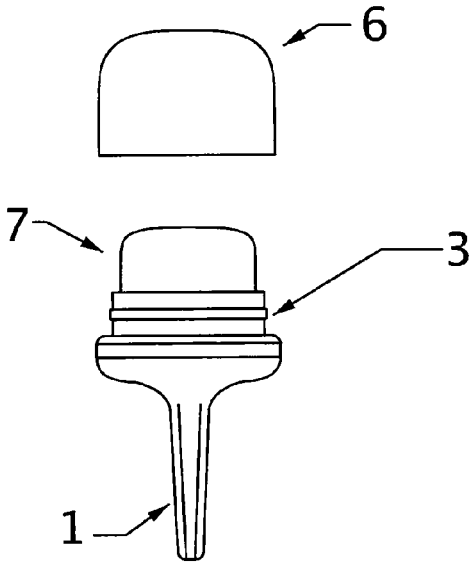

FIG. 4 is another view of the assembly seen in FIGS. 1-3 but additionally comprising personal care product 7. FIGS. 5-6 are elevational views of the front and side of the assembly seen in FIG. 4.

Figure 7:
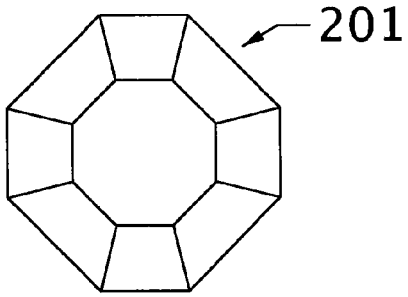
FIG. 7 is a top plan view of a decorative element used in another embodiment of the subject invention.
Figure 8:
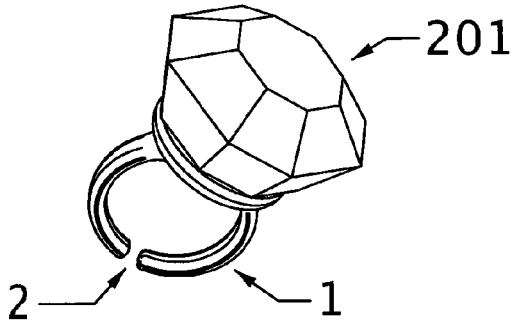
FIG. 8 is a perspective depiction of a ring and cap assembly in accordance with another embodiment of the subject invention.
Figure 9:
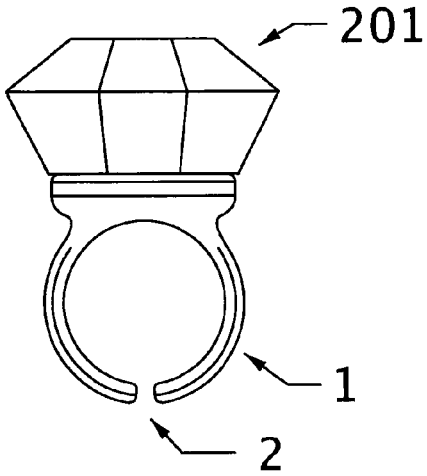
FIGS. 9-10 are elevational views of the front and side of the assembly seen in FIG. 8.
Figure 10:
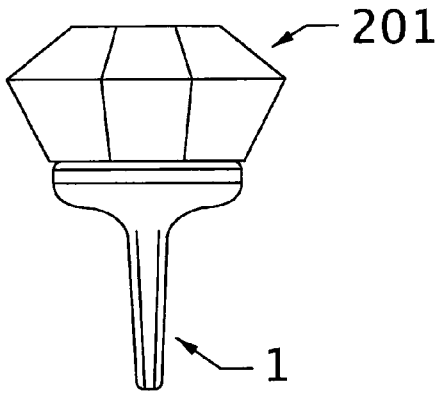

FIG. 7 is a top plan view of a decorative cap element 201 used in another embodiment of the subject invention. FIGS. 8-10 depict ring 1, size adjustment space 2 and decorative cap 201.

Figure 11:
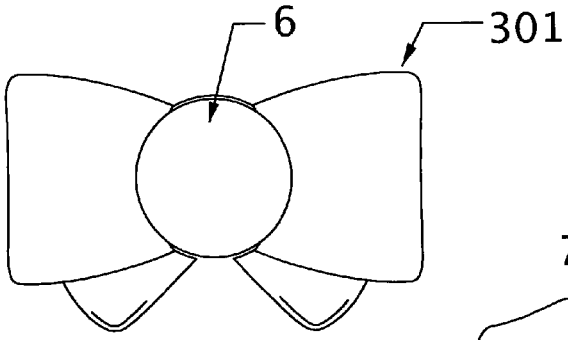
FIG. 11 is a top plan view of another decorative element used in a further embodiment of the subject invention.
Figure 12:
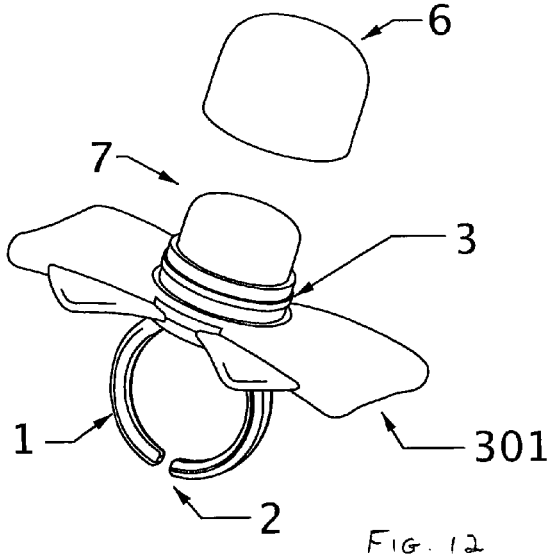
FIG. 12 is a perspective depiction of the ring and cap assembly combined with the element seen in FIG. 11.

FIG. 11 is a top plan view of another decorative cap element 301 used in a further embodiment of the subject invention. FIG. 12 depicts ring 1, size adjustment space 2, screw threads 3, personal product 7, protective cap 6 and decorative collar element 310.

Figure 13:
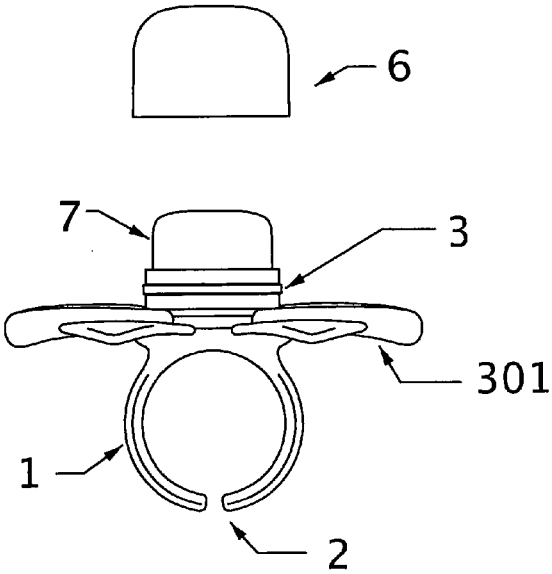
FIGS. 13-14 are elevational views of the front and side of the assembly seen in FIG. 12.
Figure 14:
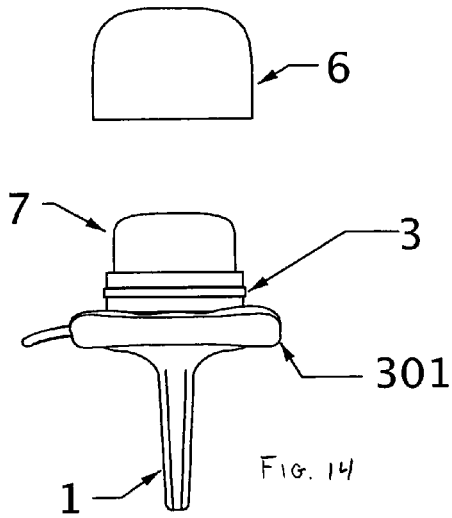

FIGS. 13-14 are elevational views of the front and side of the assembly seen in FIG. 12.

Figure 15:
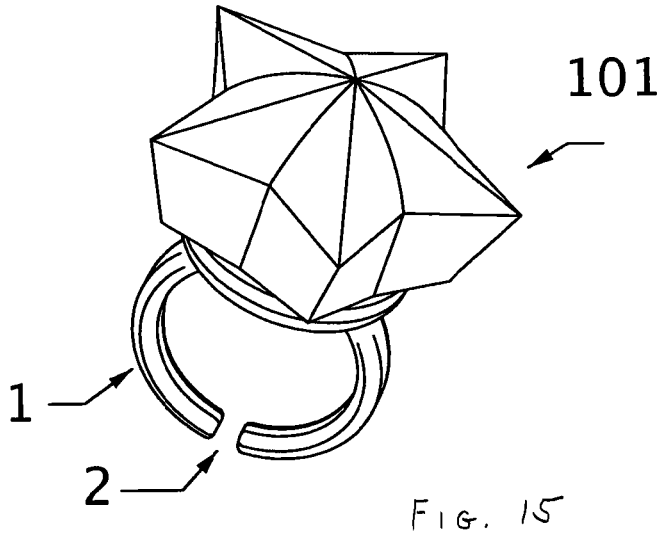
FIGS. 15-16 are perspective views of still further embodiments of the subject invention.
Figure 16:
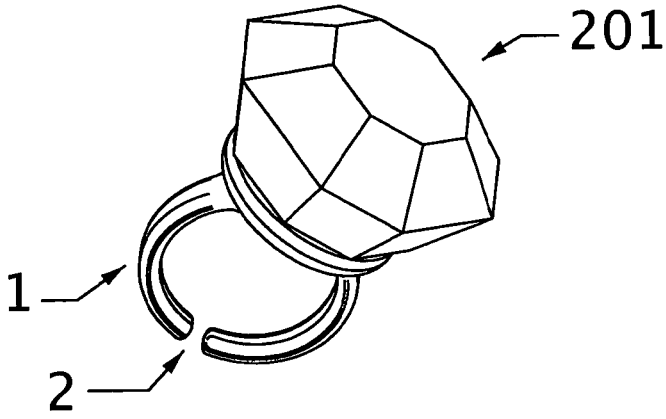

FIGS. 15-16 are perspective views of still further embodiments of the subject invention, showing respectively, alternative decorative caps 101, 201.

Figure 17:
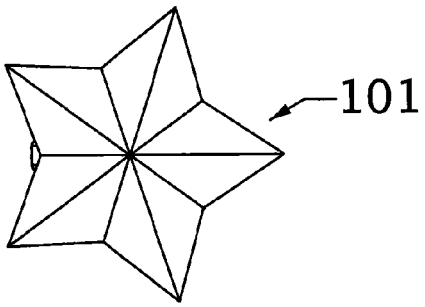
FIG. 17 is a top plan view of a decorative element used in another embodiment of the subject invention.
Figure 18:
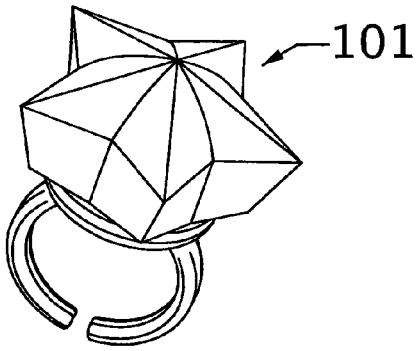
FIG. 18 is a perspective depiction of a ring and cap combined with the decorative element seen in FIG. 17.
Figure 19:
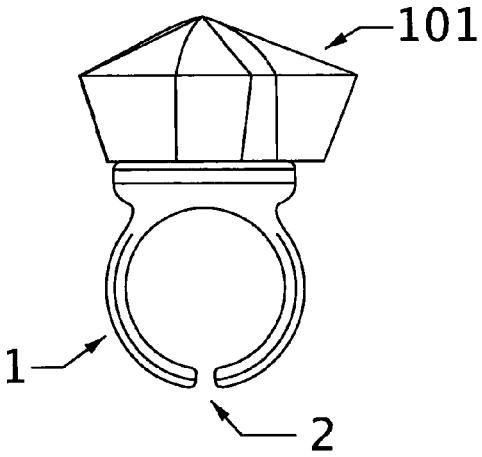
FIGS. 19-20 are elevational views of the front and side of the assembly seen in FIG. 18.
Figure 20:
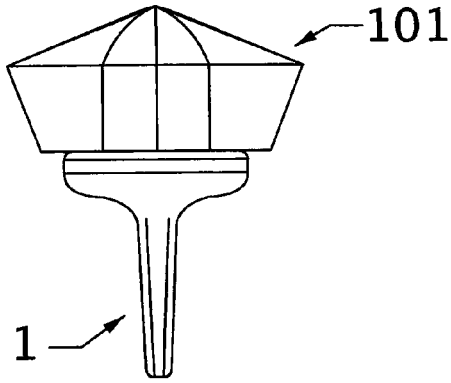

FIG. 17 is a top plan view of a decorative cap element 101 used in a further embodiment of the assembly. FIGS. 18-20 depict ring 1 and cap 101 in combination.

Figure 21:
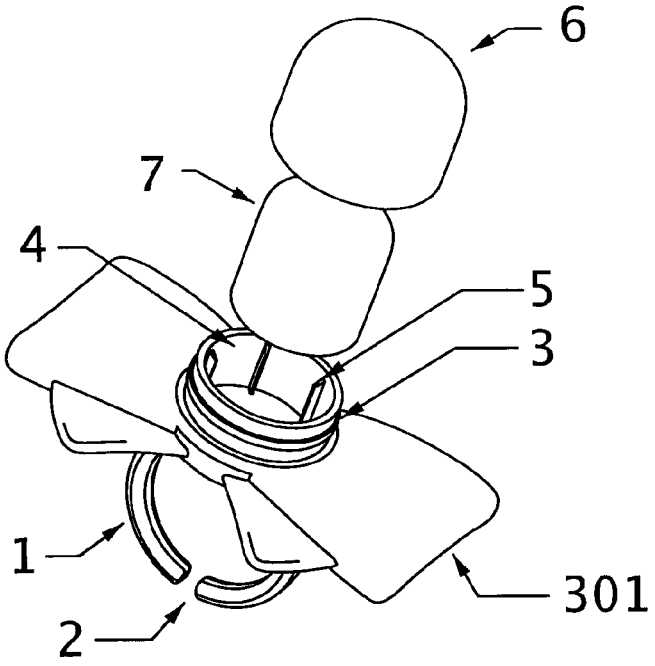
FIG. 21 is a perspective depiction of a ring and cap assembly in accordance with another embodiment of the subject invention.
Figure 22:
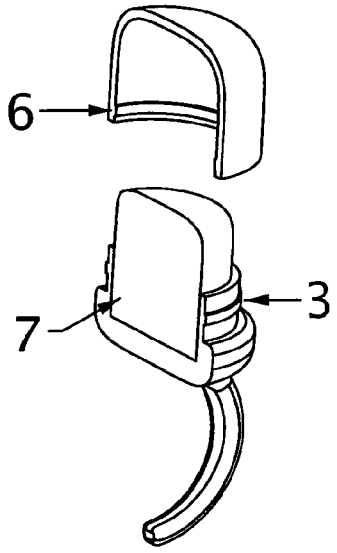
FIGS. 22-23 are cross-sectional views of the front and side of the assembly seen in FIG. 21.
Figure 23:
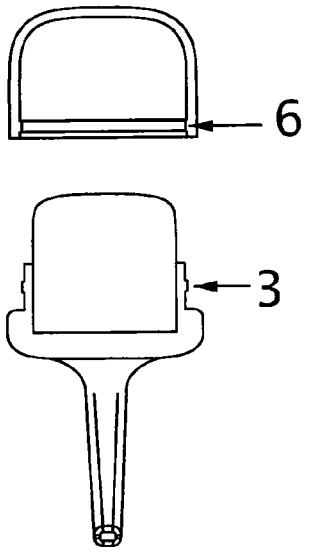

FIGS. 21-23 depict further details of a ring 1 and cap 6 assembly, showing receptacle 4, personal product 7 in the receptacle, as well as decorative collar element 301.

Figure 24:
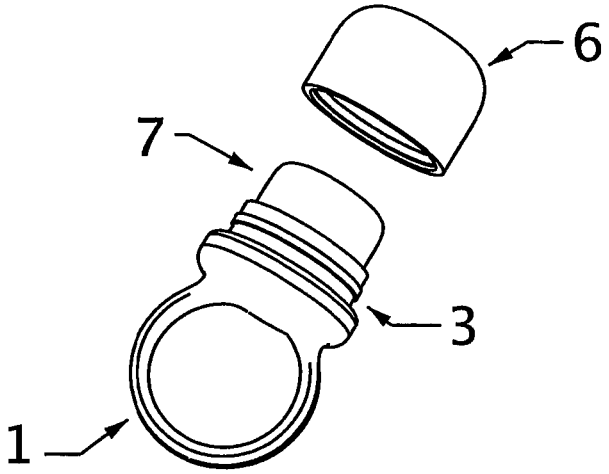
FIG. 24 is a perspective depiction of a ring and cap assembly in accordance with another embodiment of the subject invention.

FIG. 24 is a perspective depiction of a ring 1 having a solid shank and cap 6 combined in this assembly with personal product 7.

The invention now being fully described, it will be apparent to one of ordinary skill in the art that many changes and modifications can be made thereto without departing from the spirit or scope of the invention as set forth herein.

The invention claimed is:

1. A decorative wearable ring assembly comprising:

a. a ring shank portion, integrally or mechanically connected to b. a personal care product receptacle having a solid consumable personal care product therein and including an inner opening adapted to contain and protect said personal care product, said personal care product receptacle being mechanically or frictionally connected to c. a protective cap element having a shape matching that of said receptacle for containing and protecting said personal care product stored in the receptacle, wherein the personal care product receptacle further comprises at least one friction inducing protrusion positioned entirely below an upper edge of said receptacle for facilitating storage of said personal care product, and wherein the personal care product is provided so that an upper applying surface thereof is raised above said upper edge of said containing receptacle such that approximately one half of said personal care product extends beyond said upper edge of said receptacle and is exposed when said cap is removed to thereby enable a user to conveniently apply said personal care product.

2. The wearable ring assembly of claim 1 wherein said ring shank portion is sized to fit a wearer's finger.

3. The wearable ring assembly of claim 1 wherein said ring shank portion is adjustable to fit a wearer's finger.

4. The wearable ring assembly of claim 1 wherein the ring is made from jewelry grade materials selected from precious metals or costume jewelry grade materials selected from non-precious metals, thermo-formable plastic resins, ceramics and leather materials.

5. The wearable ring assembly of claim 1 wherein the personal care product receptacle further includes a member selected from the group consisting of friction fittings, screw cap fittings, and snap cap fittings for connecting and holding secure the protective cap.

6. The wearable ring assembly of claim 5 wherein said group member for connecting and holding secure the protective cap is a friction fitting.

7. The wearable ring assembly of claim 5 wherein said group member for connecting and holding secure the protective cap is a screw-cap fitting.

8. The wearable ring assembly of claim 5 wherein said group member for connecting and holding secure the protective cap is a snap-cap fitting.

9. The wearable ring assembly of claim 1 wherein the protective cap element comprises a decorative cap.

10. The wearable ring assembly of claim 1 further comprising a personal care product.

11. The wearable ring assembly of claim 10 wherein the personal care product is a skin care product.

12. The wearable ring assembly of claim 10 wherein the personal care product is a lip care product.

13. The wearable ring assembly of claim 10 wherein the personal care product is a a personal or therapeutic lotion, ointment, balm, gloss or cosmetic product.

14. The wearable ring of claim 1 wherein said personal care product is intended for use by children.

* * * * *